US009829296B1

(12) United States Patent
Askin et al.

(10) Patent No.: US 9,829,296 B1
(45) Date of Patent: Nov. 28, 2017

(54) EXPLOSIVE CONTAINER POSTIONING SADDLE FOR MUNITION DEMOLITION

(71) Applicant: Department of the Navy, Washington, DC (US)

(72) Inventors: Dennis Askin, King George, VA (US); Lee R Foltz, Indian Head, MD (US); Angel Diaz, Lorton, VA (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/756,688

(22) Filed: Sep. 30, 2015

(51) Int. Cl.

| | |
|---|---|
| ***F42D 3/00*** | (2006.01) |
| ***F42B 99/00*** | (2006.01) |
| ***F16M 13/02*** | (2006.01) |
| ***F42B 33/06*** | (2006.01) |
| ***F42D 5/04*** | (2006.01) |
| *F42B 15/34* | (2006.01) |
| *F42B 1/00* | (2006.01) |
| *F42B 1/02* | (2006.01) |
| *F42B 4/26* | (2006.01) |
| *F42B 4/06* | (2006.01) |
| *F42B 4/00* | (2006.01) |

(Continued)

(52) U.S. Cl.
CPC ..... *F42B 99/00* (2013.01); *F16M 13/02* (2013.01); *F42B 33/06* (2013.01); *F42B 33/067* (2013.01); *F42D 3/00* (2013.01); *F42D 5/04* (2013.01); *F42D 99/00* (2013.01)

(58) Field of Classification Search
CPC ..... F41A 21/06; F41A 21/08; F41A 21/18; F41F 3/065; F41F 1/06; F41F 1/08; F41F 3/04; F41F 3/042; E04H 12/22; E04H 12/2238; E04H 12/2269; F42B 4/20; F42B 4/24; F42B 4/26; F42B 4/22; F42B 12/46; F42B 5/145; F42B 99/00; F42D 99/00; F42D 5/04
USPC ..... 248/512, 515, 519, 534, 535, 538, 539, 248/346.01, 346.03; 102/343, 349, 358, 102/486, 345, 505, 293, 331; 89/1.41, 89/1.816, 1.817, 1.1, 1.3, 1.59, 1.815, 89/1.819
See application file for complete search history.

(56) References Cited

U.S. PATENT DOCUMENTS 1,539,027 A * 5/1925 Stone ..... F41F 1/06 102/399
3,708,563 A * 1/1973 Sells ..... F42B 39/26 264/255

(Continued)

FOREIGN PATENT DOCUMENTS

DE EP 2219008 A2 * 8/2010 ..... F41A 23/20

OTHER PUBLICATIONS

EP 221908, Aug. 18, 2010, Machine Translation, p. 2-4.*

*Primary Examiner* — Leslie A Nicholson, III
*Assistant Examiner* — Taylor L Morris
(74) *Attorney, Agent, or Firm* — Fredric J. Zimmerman

(57) ABSTRACT

An explosive container positioning saddle for munition demolition includes a base having a first surface defined by a portion of a cylindrical shape with a longitudinal axis. The base includes a second surface opposing the first surface. Sleeves are coupled to the second surface of the base and extend away therefrom. Each of the sleeves has a longitudinal axis and is oriented such that the longitudinal axis associated therewith is aligned to intersect with the longitudinal axis of the cylindrical shape.

11 Claims, 3 Drawing Sheets

(51) Int. Cl.

| | |
|---|---|
| *A47B 91/00* | (2006.01) |
| *A47G 29/00* | (2006.01) |
| *B65D 19/00* | (2006.01) |
| *A47B 97/00* | (2006.01) |
| *B64D 1/04* | (2006.01) |
| *F41F 5/00* | (2006.01) |
| *F41F 3/04* | (2006.01) |
| *F42D 99/00* | (2009.01) |

(56) References Cited

U.S. PATENT DOCUMENTS 3,910,084 A * 10/1975 Paton ..... B21D 26/08 220/503
4,362,243 A 12/1982 Deyesso et al.
4,470,336 A * 9/1984 Swann ..... F41A 23/42 89/1.815
4,597,496 A 7/1986 Kaplain
4,646,618 A * 3/1987 Kurth ..... B29C 47/0004 89/1.816
5,429,053 A * 7/1995 Walker ..... F42B 4/20 102/342
5,452,640 A * 9/1995 Bovee ..... F41F 3/04 89/1.815
5,452,810 A 9/1995 Schwartz
5,628,400 A 5/1997 Feder
5,979,329 A * 11/1999 Collar ..... F42B 4/22 102/342
6,325,251 B1 12/2001 Santos
6,457,415 B1 * 10/2002 Peter Sung Yan ..... F42B 4/22 102/361
6,626,402 B1 9/2003 Kaminstein
6,629,597 B2 10/2003 Barker
7,007,584 B2 * 3/2006 Caballer Barat ..... F42B 3/26 102/343
7,314,005 B2 * 1/2008 Deye ..... F42B 4/00 102/356
8,118,157 B1 * 2/2012 Piccolin ..... F42B 4/20 102/343
8,536,500 B2 * 9/2013 Glasson ..... F41A 27/22 244/3.1
8,695,263 B2 * 4/2014 Murray ..... F42B 33/0228 110/237
2007/0084336 A1 * 4/2007 Neves ..... E21B 43/119 89/1.3
2008/0006168 A1 * 1/2008 Huang ..... F42B 4/20 102/358
2011/0204202 A1 * 8/2011 Masters ..... F16L 3/22 248/513
2014/0007787 A1 * 1/2014 Caballer Barat ..... F42B 4/20 102/357
2015/0176946 A1 * 6/2015 Montgomery ..... F41F 1/06 89/1.816

* cited by examiner

EXPLOSIVE CONTAINER POSTIONING SADDLE FOR MUNITION DEMOLITION

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to munition demolition, and more particularly to a positioning saddle that positions explosive containers at the surface of a munition that is to be detonated.

BACKGROUND OF THE INVENTION

The demolition of dud or unused munitions is typically accomplished by attaching one or more explosive devices to a munition casing. Placement of the explosive devices for effective demolition is an inexact process leading to demolition operations that can be ineffective and/or dangerous.

SUMMARY OF THE INVENTION

Accordingly, it is an object of the present invention to provide an apparatus that positions explosive devices on a munition that is to be detonated.

Another object of the present invention is to provide an apparatus that positions explosive devices on a munition such that munition demolition is guaranteed to be effective.

Other objects and advantages of the present invention will become more obvious hereinafter in the specification and drawings.

In accordance with the present invention, an explosive container positioning saddle for munition demolition includes a base having a first surface defined by a portion of a cylindrical shape having a longitudinal axis. The base has a second surface opposing the first surface. Sleeves are coupled to the second surface of the base and extend away therefrom. Each of the sleeves has a longitudinal axis. Each of the sleeves is oriented such that the longitudinal axis associated therewith is aligned to intersect with the longitudinal axis of the cylindrical shape.

BRIEF DESCRIPTION OF THE DRAWINGS

Other objects, features and advantages of the present invention will become apparent upon reference to the following description of the exemplary embodiments and to the drawings, wherein corresponding reference characters indicate corresponding parts throughout the several views of the drawings and wherein.

DETAILED DESCRIPTION OF THE INVENTION

Figure 1:
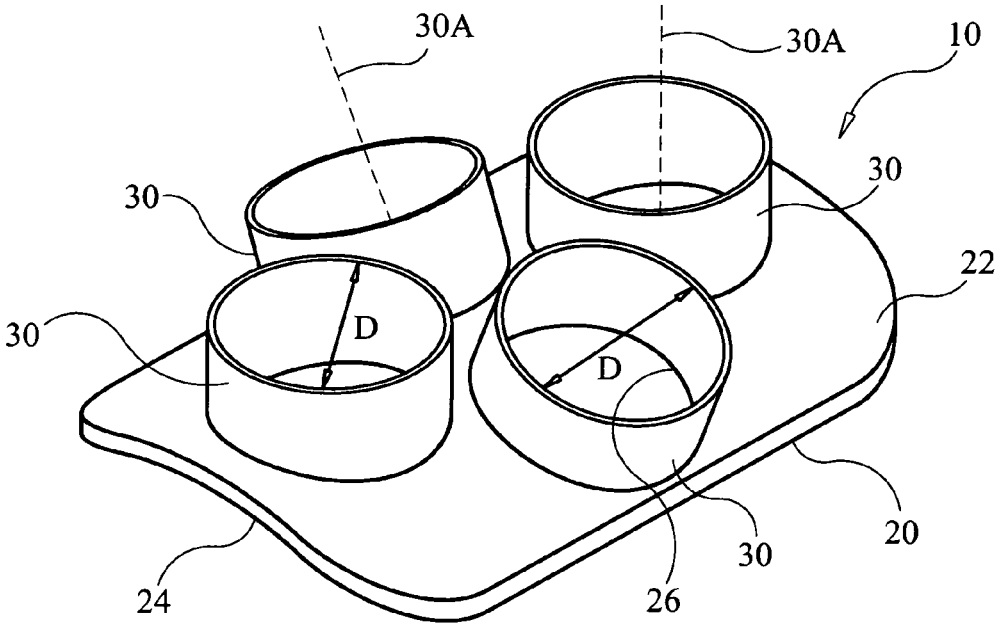
FIG. 1 is a perspective view of an explosive container positioning saddle in accordance with an embodiment of the present invention.
Figure 2:
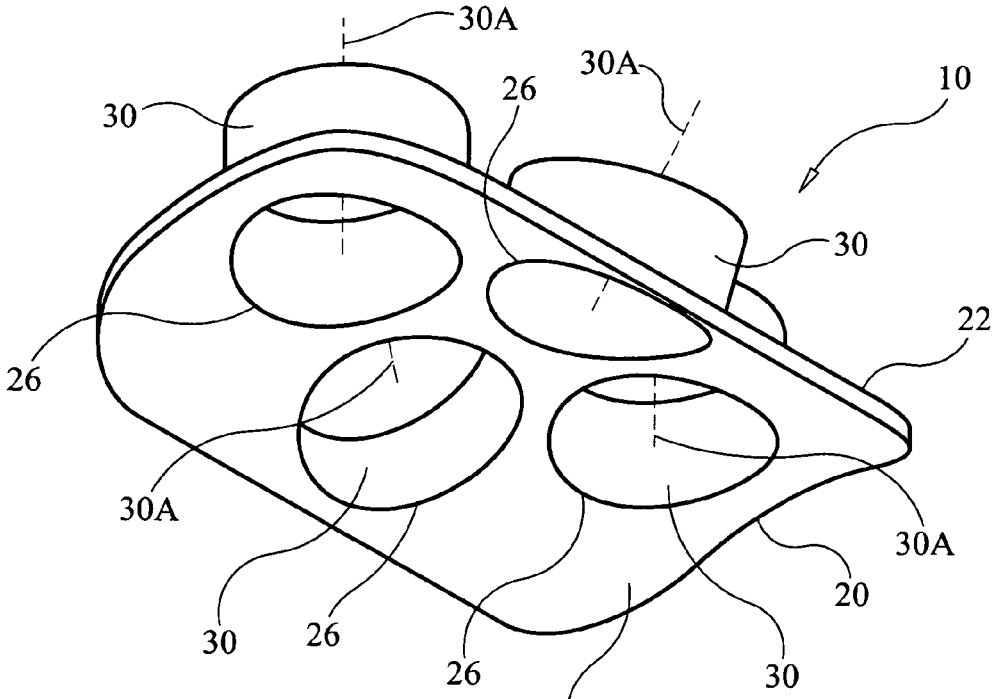
FIG. 2 is a perspective view of the underside of the explosive container positioning saddle illustrated in FIG. 1.
Figure 3:
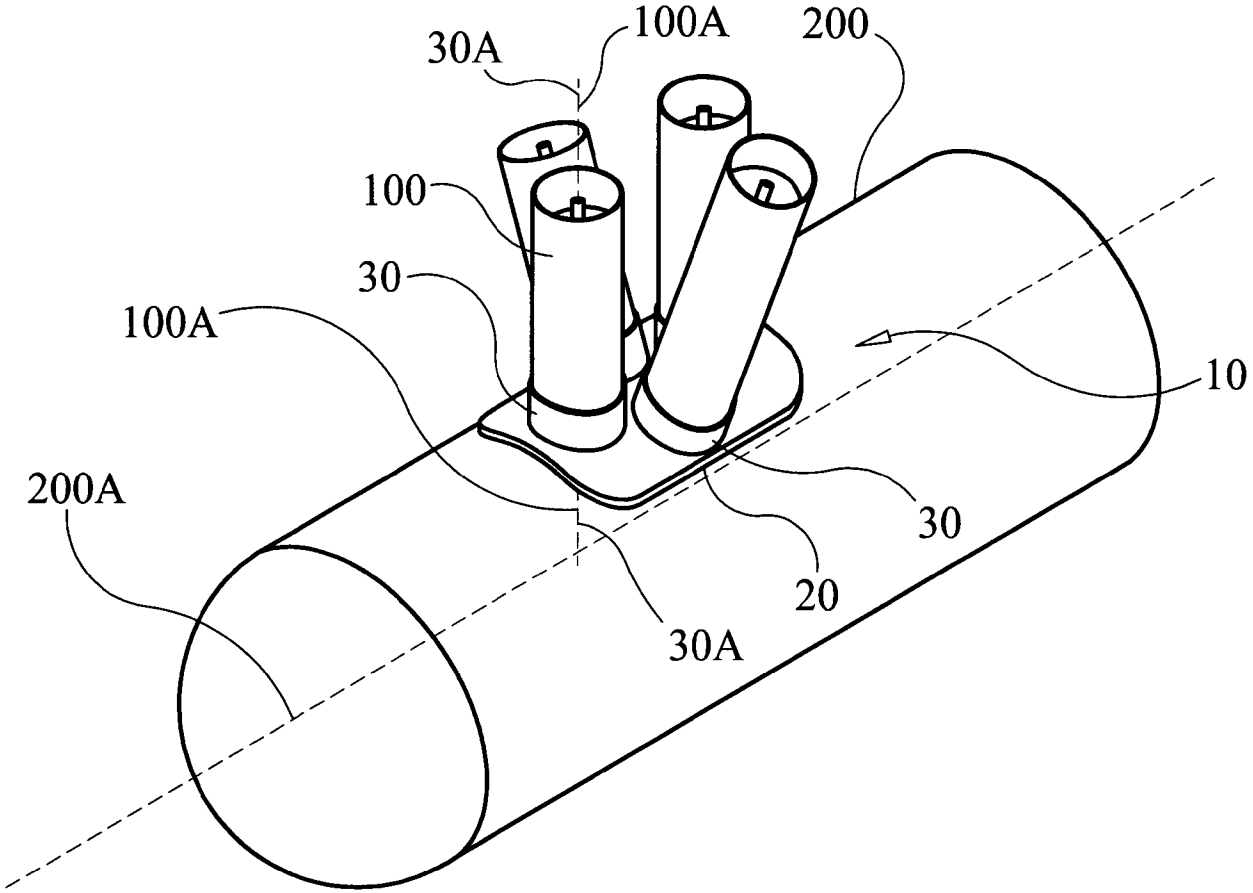
FIG. 3 is a perspective view of the explosive container positioning saddle illustrated in FIG. 1 with an explosive container in each sleeve of the saddle in accordance with an embodiment of the present invention.

Referring now to the drawings, simultaneous reference will be made to FIGS. 1-3 where an explosive container positioning saddle in accordance with an exemplary embodiment of the present invention is shown and is referenced generally by numeral 10. FIGS. 1 and 2 illustrate saddle 10 in top and bottom, respectively, perspective views. FIG. 3 illustrates saddle 10 positioning four explosive containers 100 adjacent to the surface (or casing) of a cylindrical munition 200. While saddle 10 clusters four explosive containers 100 adjacent to munition 200, saddles in accordance with the present invention may be configured to position fewer than four or more than four explosive containers without departing from the scope of the present invention.

Saddle 10 includes a base 20 and a plurality of alignment sleeves 30 clustered together. Base 20 and sleeves 30 may be made from a various materials, including plastic material, the choice of which is not a limitation of the present invention. Base 20 and sleeves 30 may be constructed to be integral with one another using, for example, injection molding techniques, three-dimensional printing techniques, or other techniques.

In general, base 20 is shaped as a portion of a cylindrical shape whose size/shape is defined by cylindrical munition 200 (FIG. 3). More specifically, the underside surface 22 of base 20 that will rest on munition 200 is matched in size and shape to the cylindrical exterior surface of munition 200. In other words, underside surface 22 essentially defines a portion of a cylinder (i.e., munition 200) having longitudinal axis 200A. The topside surface 24 of base 20 may be parallel to underside surface 22 thereby making the thickness of base 20 constant.

Each of (the plurality of) sleeves 30 defines an interior shape that will cooperate with an explosive container 100 in order to hold/position container 100 in saddle 10. In the illustrated exemplary embodiment, explosive containers 100 are cylindrical so that sleeves 30 are also cylindrical. Holding/positioning of containers 100 may be achieved, for example, when the diameter "D" of each sleeve 30 provides for a press-fit engagement between the outer surface of container 100 and sleeve 30.

Each sleeve 30 also has a longitudinal axis 30A. Sleeves 30 in base 20 are oriented such that each sleeve's longitudinal axis 30A is aligned to intersect with longitudinal axis 200A of munition 200. In other words, each sleeve's longitudinal axis 30A is aligned to intersect with the longitudinal axis of a cylindrical shape defined by the underside surface 22 of base 20. In this way, when saddle 10 with explosive containers 100 is placed on munition 200, the longitudinal axis 100A of each explosive container is coincident with sleeve axis 30A and is guaranteed to intersect with the longitudinal axis 200A of munition 200. Since underside surface 22 is matched to the cylindrical surface of munition 200, proper alignment of explosive containers 100 is guaranteed when base 20 is attached (e.g., glued, taped, etc.) to munition 200. By guaranteeing such alignment, the right combination of pressure waves are able to collide to produce the desired effect.

In order to allow the explosive force of each detonated explosive container 100 to act, directly, on munition 200, base 20 has holes 26 aligned with each of sleeves 30. Each hole 26 extends entirely through base 20, i.e., from underside surface 22 to topside surface 24.

Figure 4:
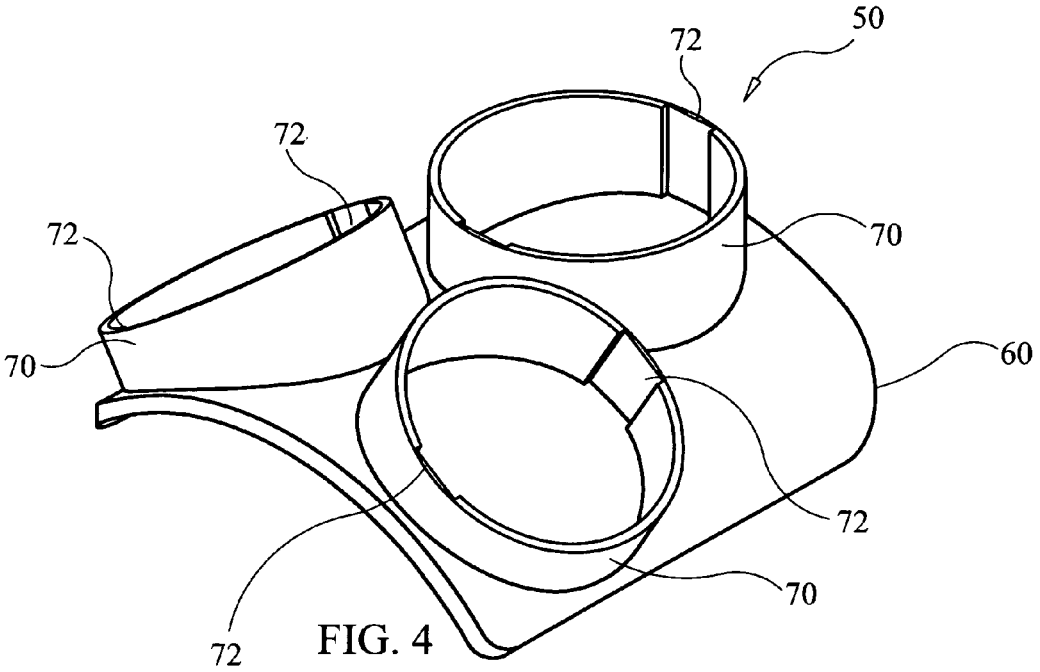
FIG. 4 is a perspective view of an explosive container positioning saddle in accordance with another embodiment of the present invention.
Figure 5:
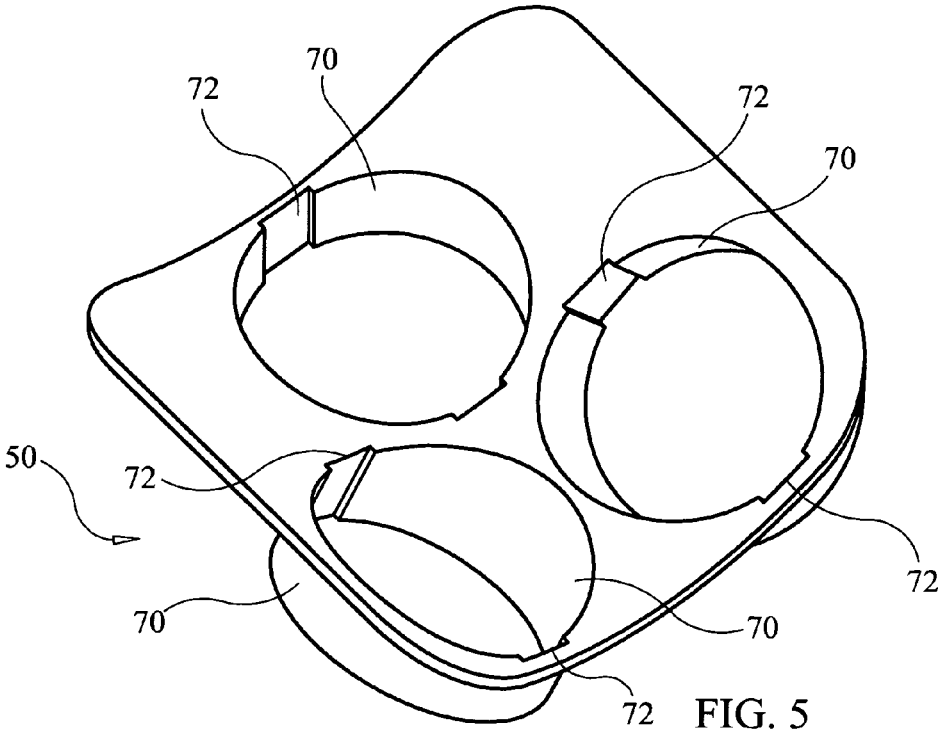
FIG. 5 is a perspective view of the underside of the explosive container positioning saddle illustrated in FIG. 4.

As mentioned above, the present invention is not limited to four alignment sleeves as just described. For example, FIGS. 4 and 5 illustrate another exemplary embodiment of the present invention where a saddle 50 has a base 60 and three alignment sleeves 70. Saddle 50 is constructed to have the same explosive container alignment attributes described above. In addition, sleeves 70 have indexing channels 72 defined axially along an inner surface thereof. Channels 72 may be provided to cooperate with outer surface protrusions present on other types of explosive containers (not shown). In still other exemplary embodiments, the inner surface of the sleeves may be threaded to cooperate with threads on explosive containers.

The advantages of the present invention are numerous. The saddle defines optimal clustered positions for explosive containers used in munition demolition. Optimal positioning is achieved simply by placing the saddle on a munition casing thereby eliminating guesswork related to explosive container positioning.

Although the invention has been described relative to a specific exemplary embodiment thereof, there are numerous variations and modifications that will be readily apparent to those skilled in the art in light of the above teachings. It is therefore to be understood that, within the scope of the appended claims, the invention may be practiced other than as specifically described.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should be at least construed in light of the number of significant digits and by applying ordinary rounding.

What is claimed as new and desired to be secured by Letters Patent of the United States is:

1. An explosive container positioning saddle for munition demolition, comprising:

a base consisting of a first surface being defined by a portion of a cylindrical shape, including a longitudinal axis, and a second surface, said base includes the second surface, which opposes said first surface; and a plurality of sleeves being coupled to said second surface of said base and extending away therefrom, wherein each of said plurality of sleeves includes a longitudinal axis, and wherein said each of said plurality of sleeves is oriented such that said longitudinal axis associated therewith is aligned to intersect with said longitudinal axis of said cylindrical shape, wherein said each of the plurality of sleeves is comprised of a cylindrical shaped structure with a first hole opening and a second hole opening located at respective ends of the cylindrical shaped structure, wherein the base includes a plurality of holes where each of the plurality of holes is aligned and integral with a respective said second hole opening of said each of the plurality of sleeves, wherein the base and the plurality of sleeves are a single base-sleeve structure as a result of manufacturing techniques, and wherein said each of the plurality of holes extends entirely through the base, wherein said plurality of sleeves is comprised of a plurality of the sleeves, which are off-set from each other, and wherein said each of said plurality of sleeves includes at least one straight shaved indexing channel defined along an inner axial surface thereof.

2. The explosive container positioning saddle as in claim 1, wherein said each of said plurality of sleeves comprises a cylindrical sleeve.

3. The explosive container positioning saddle as in claim 1, wherein said base and said plurality of sleeves are comprised of a plastic material.

4. The explosive container positioning saddle as in claim 1, wherein said second surface is parallel to said first surface.

5. The explosive container as in claim 1, wherein said each of the plurality of sleeves and said each of the plurality of holes of the base have a same diameter.

6. An explosive container positioning saddle for munition demolition, comprising:

a base comprising a first surface being defined by a portion of a cylindrical shape including a longitudinal axis, said base includes a second surface, which opposes said first surface; and a plurality of cylindrical sleeves being coupled to said second surface of said base and extending away therefrom, wherein each of said plurality of cylindrical sleeves includes a longitudinal axis, wherein said each of said plurality of cylindrical sleeves is oriented such that said longitudinal axis associated therewith is aligned to intersect with said longitudinal axis of said cylindrical shape, wherein, for said each of said plurality of cylindrical sleeves, said base includes a hole aligned therewith, wherein the base includes a plurality of holes where each said hole is aligned with said each of the plurality of sleeves, and wherein said each hole of the plurality of holes extends through the base, wherein said plurality of sleeves is comprised of a plurality of the sleeves, which are off-set from each other, and wherein said each of said plurality of sleeves includes at least one straight shaped indexing channel defined along an inner axial surface thereof.

7. The explosive container positioning saddle as in claim 6, wherein said base and said plurality of cylindrical sleeves are integral with one another.

8. The explosive container positioning saddle as in claim 6, wherein said base and said plurality of cylindrical sleeves are comprised of a plastic material.

9. The explosive container positioning saddle as in claim 6, wherein said second surface is parallel to said first surface.

10. An explosive container positioning saddle for munition demolition, comprising:

a base comprising a first surface being defined by a portion of a cylindrical shape including a longitudinal axis, said base includes a second surface opposite and parallel to said first surface; and a cluster of cylindrical sleeves being integrated with said base and extending away from said second surface thereof, wherein each of said cluster of cylindrical sleeves includes a longitudinal axis, and wherein each of said cluster of cylindrical sleeves is oriented such that said longitudinal axis associated therewith is aligned to intersect with said longitudinal axis of said cylindrical shape, wherein, for each of said cylindrical sleeves, said base includes a hole aligned therewith, wherein the base includes a plurality of holes where each said hole is aligned with said each of the cluster of cylindrical sleeves, and wherein said each hole of the plurality of holes extends through the base, wherein said cluster of cylindrical sleeves is comprised of a cluster of cylindrical sleeves, which are off-set from each other, and wherein said each of said cluster of cylindrical sleeves includes at least one straight shaped indexing channel defined along an inner axial surface thereof.

11. The explosive container positioning saddle as in claim 10, wherein said base and said cylindrical sleeves are comprised of a plastic material.

* * * * *